US009224279B2

(12) United States Patent
Iwasaki

(10) Patent No.: US 9,224,279 B2
(45) Date of Patent: Dec. 29, 2015

(54) TOUR MONITORING DEVICE

(75) Inventor: Takahiro Iwasaki, Kiyose (JP)

(73) Assignee: CANON KABUSHIKI KAISHA (JP)

( * ) Notice: Subject to any disclaimer, the term of this patent is extended or adjusted under 35 U.S.C. 154(b) by 920 days.

(21) Appl. No.: 12/417,034

(22) Filed: Apr. 2, 2009

(65) Prior Publication Data

US 2009/0251539 A1 Oct. 8, 2009

(30) Foreign Application Priority Data

Apr. 4, 2008 (JP) ..... 2008-098366
Mar. 23, 2009 (JP) ..... 2009-069951

(51) Int. Cl.
*G08B 13/196* (2006.01)

(52) U.S. Cl.
CPC ..... *G08B 13/1968* (2013.01); *G08B 13/19602* (2013.01); *G08B 13/19608* (2013.01); *G08B 13/19613* (2013.01)

(58) Field of Classification Search
CPC ..... H04N 5/23206; H04N 5/23216; H04N 5/23222; H04N 5/23225; H04N 5/23245; H04N 5/23296; G08B 13/19604; G08B 13/19606; G08B 13/19608; G08B 13/19613; G08B 13/19615; G08B 13/19652; G08B 13/1968; G08B 13/19682; G08B 13/19689
USPC ..... 348/143
See application file for complete search history.

(56) References Cited

U.S. PATENT DOCUMENTS 6,005,493 A * 12/1999 Taniguchi et al. ..... 340/990
6,144,797 A * 11/2000 MacCormack et al. ..... 386/224
6,404,455 B1 * 6/2002 Ito et al. ..... 348/169
6,727,938 B1 4/2004 Randall
6,738,424 B1 * 5/2004 Allmen et al. ..... 375/240.08
6,865,580 B1 * 3/2005 Bush ..... 717/116
7,257,235 B2 * 8/2007 Kawakami et al. ..... 382/103
7,355,627 B2 * 4/2008 Yamazaki et al. ..... 348/143
7,436,887 B2 10/2008 Yeredor et al.
7,468,662 B2 12/2008 Velipasalar et al.
7,813,528 B2 * 10/2010 Porikli et al. ..... 382/103

(Continued)

FOREIGN PATENT DOCUMENTS

JP 6-105312 A 4/1994
JP 2002-290789 A 10/2002

(Continued)

OTHER PUBLICATIONS

Extended European Search Report issued in corresponding European Patent Application No. 09156297.5 dated Jul. 17, 2009.

*Primary Examiner* — Blake Rubin
(74) *Attorney, Agent, or Firm* — Rossi, Kimms & McDowell LLP

(57) ABSTRACT

A monitoring device that is capable of setting both of the tour monitoring time and the unmoving object monitoring time without restriction. A tour monitoring unit causes an image pickup unit to perform a tour monitoring. An unmoving object monitoring unit performs an unmoving object detection process and an unmoving object determination process at positions subjected to the tour monitoring. A control unit performs a control such that the tour monitoring is performed at a position different from the position where the unmoving object detection process is performed after the unmoving object detection process is performed and the unmoving object determination process is performed after the tour monitoring is performed at the different position.

7 Claims, 12 Drawing Sheets

(56) References Cited

U.S. PATENT DOCUMENTS

| | | | | |
|---|---|---|---|---|
| 7,868,912 | B2 * | 1/2011 | Venetianer et al. | 348/143 |
| 7,961,946 | B2 * | 6/2011 | Hammadou | 382/181 |
| 2001/0019357 | A1 * | 9/2001 | Ito et al. | 348/152 |
| 2004/0100563 | A1 * | 5/2004 | Sablak et al. | 348/211.4 |
| 2004/0145658 | A1 * | 7/2004 | Lev-Ran et al. | 348/143 |
| 2004/0201753 | A1 * | 10/2004 | Kondo et al. | 348/239 |
| 2004/0240542 | A1 * | 12/2004 | Yeredor et al. | 375/240.01 |
| 2005/0018879 | A1 * | 1/2005 | Ito et al. | 382/103 |
| 2005/0024206 | A1 * | 2/2005 | Samarasekera et al. | 340/541 |
| 2005/0036658 | A1 * | 2/2005 | Gibbins et al. | 382/103 |
| 2005/0073585 | A1 * | 4/2005 | Ettinger et al. | 348/155 |
| 2005/0104958 | A1 * | 5/2005 | Egnal et al. | 348/143 |
| 2006/0159308 | A1 * | 7/2006 | Hampapur et al. | 382/103 |
| 2006/0179463 | A1 * | 8/2006 | Chisholm et al. | 725/90 |
| 2006/0262959 | A1 * | 11/2006 | Tuzel et al. | 382/103 |
| 2006/0279630 | A1 * | 12/2006 | Aggarwal et al. | 348/143 |
| 2007/0035623 | A1 * | 2/2007 | Garoutte et al. | 348/143 |
| 2007/0052803 | A1 * | 3/2007 | Chosak et al. | 348/143 |
| 2007/0058717 | A1 * | 3/2007 | Chosak et al. | 375/240.08 |
| 2007/0113255 | A1 * | 5/2007 | Kurosawa | 725/105 |
| 2007/0291104 | A1 * | 12/2007 | Petersen et al. | 348/14.01 |
| 2007/0291117 | A1 | 12/2007 | Velipasalar et al. | |
| 2008/0198178 | A1 * | 8/2008 | Julin et al. | 345/661 |
| 2008/0211929 | A1 * | 9/2008 | Uchihara | 348/231.99 |
| 2009/0033745 | A1 * | 2/2009 | Yeredor et al. | 348/152 |
| 2009/0256912 | A1 * | 10/2009 | Rosenberg | 348/154 |
| 2010/0007736 | A1 * | 1/2010 | Mori et al. | 348/155 |
| 2010/0110183 | A1 * | 5/2010 | Bobbitt et al. | 348/143 |
| 2011/0149072 | A1 * | 6/2011 | McCormack | 348/143 |

FOREIGN PATENT DOCUMENTS

| | | | |
|---|---|---|---|
| JP | 2007-300531 | A | 11/2007 |
| WO | 98/47117 | A1 | 10/1998 |
| WO | 03/067884 | A1 | 8/2003 |

* cited by examiner

TOUR MONITORING DEVICE

BACKGROUND OF THE INVENTION

1. Field of the Invention

The present invention relates to a monitoring device, and more particularly, to a monitoring device characterized by a technique combined by a tour monitoring process and an unmoving object monitoring process.

2. Description of the Related Art

In recent years, a monitoring device (a monitoring system) for monitoring a suspicious person and an unidentified object from a remote place has been vigorously developed and manufactured to increase security in ordinary houses, offices and public facilities.

As a general monitoring unit of this kind of the monitoring device, there has been known a tour monitoring unit provided with an image pickup unit (a photographing unit) with a zooming function, a pan mechanism for horizontally rotating the image pickup unit and a tilt mechanism for vertically rotating the image pickup unit. The tour monitoring unit picks up images at a plurality of registered spots every constant time interval, for example, in a predetermined order (refer to Japanese Laid-Open Patent Publication (Kokai) No. 2002-290789, for example).

There has also been known an unmoving object monitoring unit which determines that an object is unidentified when the object appears in an image pickup area previously captured as a background image and notifies a user (an administrator) of the unidentified object. The unmoving object monitoring unit performs the above determination and notification when a picked up image is different from the background image due to the appearance of the object or the difference continues for a constant time interval (refer to Japanese Laid-Open Patent Publication (Kokai) Nos. 06-105312 and 2007-300531, for example).

When a single monitoring device configured by combining the above two monitoring units is operated, the determination needs to be performed before the tour monitoring unit causes the image pickup unit to pass a monitoring spot in order that the unmoving object monitoring unit determines that an object left unattended is unidentified.

In other words, a tour monitoring time of the tour monitoring unit needs to be set longer than an unmoving object monitoring time of the unmoving object monitoring unit. Such a mutual dependence of both units on each other imposes restrictions on the user in using the monitoring device.

That is to say, the tour monitoring time needs to be set shorter to quickly detect an object left unattended. On the other hand, the notification following the determination that an object left unattended is unidentified is sometimes wrong, so that the unmoving object monitoring time needs to be set longer to reduce such a wrong notification. At this point, the above restrictions cause a problem.

SUMMARY OF THE INVENTION

The present invention provides a monitoring device capable of setting both of the tour monitoring time and the unmoving object monitoring time without restriction even when the tour monitoring process and the unmoving object monitoring process are combined.

Accordingly, in a first aspect of the present invention, there is provided a monitoring device comprising a tour monitoring unit that causes an image pickup unit to perform a tour monitoring, an unmoving object monitoring unit that performs an unmoving object detection process and an unmoving object determination process at positions subjected to the tour monitoring and a control unit that performs a control such that the tour monitoring is performed at a position different from the position where the unmoving object detection process is performed after the unmoving object detection process is performed and the unmoving object determination process is performed after the tour monitoring is performed at the different position.

In a second aspect of the present invention, there is provided a monitoring device comprising a tour monitoring unit that causes an image pickup unit to cyclically monitor a plurality of previously registered monitoring spots, an unmoving object monitoring unit that monitors an unmoving object at the monitoring spot for a predetermined monitoring time based on a previously captured background image before the image pickup unit is moved from the predetermined monitoring spot by the tour monitoring unit, a storage unit that stores an unmoving object monitoring position when the unmoving object monitoring unit starts counting the monitoring time and a determination unit that determines whether the unmoving object is unidentified at the unmoving object monitoring position stored in the storage unit at a predetermined timing.

In a third aspect of the present invention, there is provided a monitoring device comprising a tour monitoring unit that causes an image pickup unit to cyclically monitor a plurality of previously registered monitoring spots, an unmoving object monitoring unit that monitors an unmoving object at the monitoring spot for a predetermined monitoring time based on a previously captured background image before the image pickup unit is moved from the predetermined monitoring spot by the tour monitoring unit, a storage unit that stores an unmoving object monitoring position when the unmoving object monitoring unit starts counting the monitoring time, a moving unit that moves the image pickup unit to the unmoving object monitoring position stored in the storage unit at a predetermined timing when the image pickup unit is moved to another monitoring spot by the tour monitoring unit while the monitoring time elapses and a determination unit that determines whether the unmoving object is unidentified at the unmoving object monitoring position to which the image pickup unit is moved by the moving unit.

According to the present invention, both of the tour monitoring time and the unmoving object monitoring time can be set without restriction even when the tour monitoring process and the unmoving object monitoring process are combined.

The features and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing preferred embodiments thereof.

Figure 1:
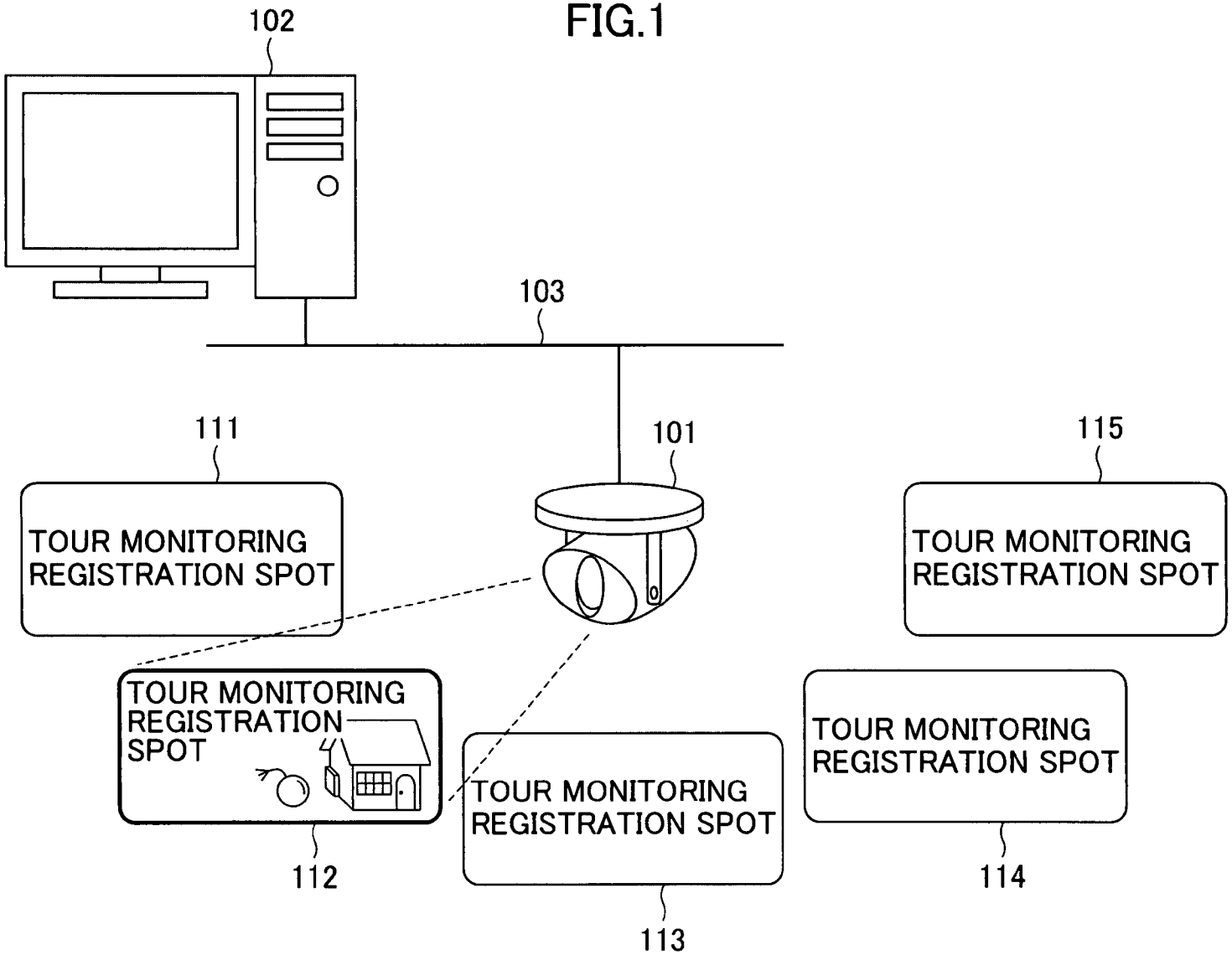
FIG. 1 is a block diagram showing the outline of a network camera monitoring system equipped with the monitoring device according to the embodiment of the present invention.

FIG. 1 is a block diagram showing the outline of a network camera monitoring system equipped with the monitoring device according to the embodiment of the present invention.

In FIG. 1, the network camera monitoring system is configured by connecting a network camera 101 and a server 102 which are components of the monitoring device with an Internet protocol (IP) network 103.

The server 102 sets the network camera 101 and displays video data (image pickup data) transmitted from the network camera 101.

The network camera 101 monitors an object to be monitored according to the setting by the server 102 and transmits captured video data to the server 102 through the IP network 103. The server 102 includes a storage medium and is capable of storing the transmitted video data therein.

Tour monitoring registration spots 111 to 115 which are different from each other are set by the server 102. The network camera 101 cyclically monitors the tour monitoring registration spots 111 to 115.

Figure 2:
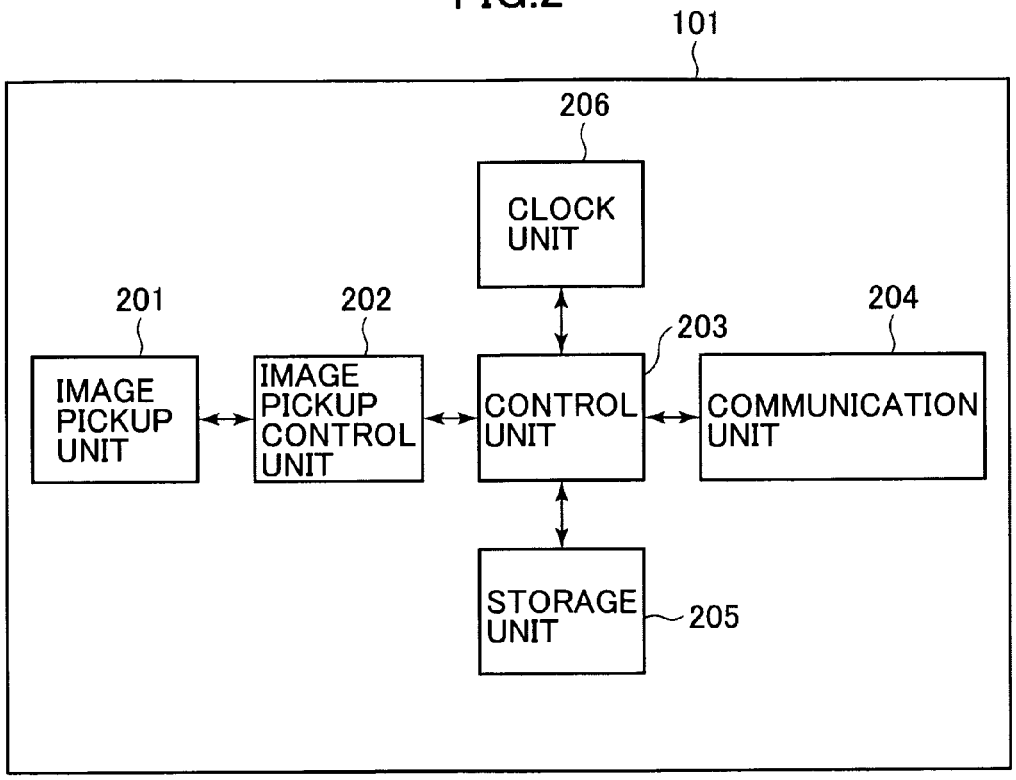
FIG. 2 is a block diagram of the network camera in FIG. 1.

FIG. 2 is a block diagram of the network camera in FIG. 1.

As shown in FIG. 2, the network camera 101 is provided with an image pickup unit 201 which captures an object (to pick up an image), an image pickup control unit 202 which performs the image pickup control such as zoom, focus, pan, tilt of the image pickup unit 201 and a control unit 203 which controls the entire system of the network camera 101.

The control unit 203 includes a central processing unit (CPU), a program memory and a work memory. The CPU develops a control program stored in the program memory into the work memory and executes it to control the entire system of the network camera 101.

The network camera 101 includes a communication unit 204 which transmits video data to the server 102 and receives setting data from the server 102 through the IP network 103.

The network camera 101 includes a storage unit 205 and a clock unit 206. The storage unit stores the video data picked up by the image pickup unit 201, the set data received by the communication unit 204, the control data of the control unit 203 and so on. The clock unit 206 counts a tour monitoring timer and an unmoving object monitoring timer. The clock unit 206 can receive a plurality of counts to be registered. The clock unit 206 returns a timer ID for identifying a timer that has expired at the time of receiving counts to be registered and makes notification of the expiration along with the timer ID issued at the time of receiving the timer if the timer expires.

Figure 3:
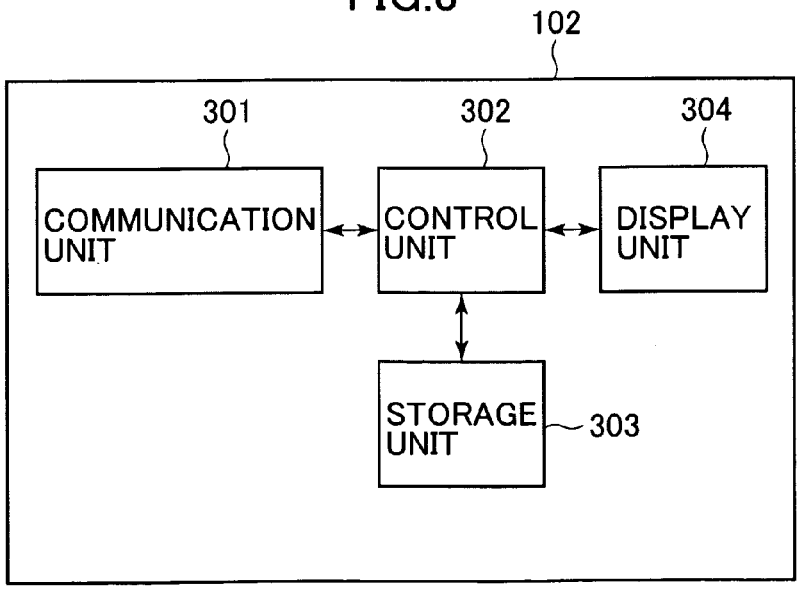
FIG. 3 is a block diagram of the server in FIG. 1.

FIG. 3 is a block diagram of the server in FIG. 1.

As shown in FIG. 3, the server 102 includes a communication unit 301 which communicates with the network camera 101 and a control unit 302 which controls the entire system of the server 102.

The control unit 302 includes a central processing unit (CPU), a program memory and a work memory. The CPU develops a control program stored in the program memory into the work memory and executes it to control the entire system of the server 102.

The server 102 includes a storage unit 303 which stores the program for setting the network camera 101 and the video data transmitted from the network camera 101 through the communication unit 301.

The server 102 includes a display unit 304 which displays the video data transmitted from the network camera 101 through the communication unit 301 on a display.

Figure 4:
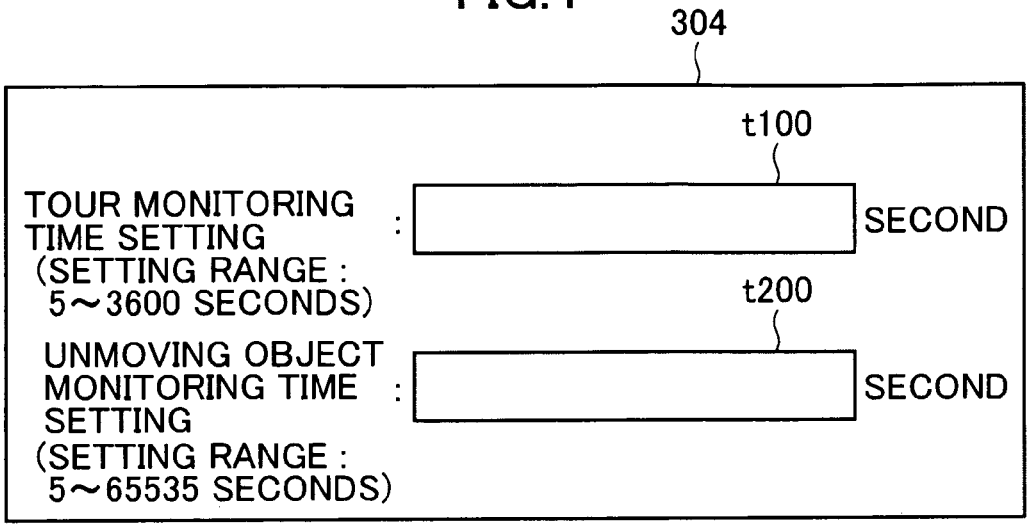
FIG. 4 is a diagram showing a setting screen for setting the tour monitoring time and the unmoving object monitoring time in the server in FIG. 3.

FIG. 4 is a diagram showing a setting screen for setting the tour monitoring time and the unmoving object monitoring time in the server in FIG. 3.

A tour monitoring time (setting time for the tour monitoring timer) t100 and an unmoving object monitoring time (setting time for the unmoving object monitoring timer) t200 are set by the server 102 to the network camera 101. The setting screen is displayed on the display unit 304 of the server 102. The tour monitoring time t100 and the unmoving object monitoring time t200 are saved (stored) in the storage unit 205 of the network camera 101.

Figure 5:
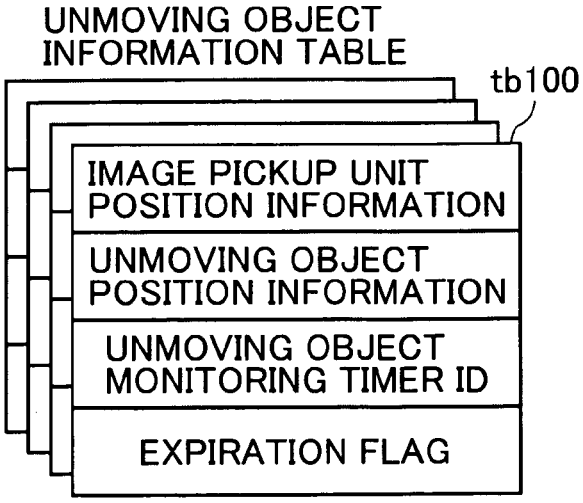
FIG. 5 is a diagram showing an unmoving object information table stored in the storage unit in FIG. 2.

FIG. 5 is a diagram showing an unmoving object information table stored in the storage unit in FIG. 2.

An unmoving object information table tb100 stored in the storage unit 205 is information used by the control unit 203 of the network camera 101 when a plurality of unmoving objects is monitored in parallel with a combination of the tour monitoring process and the unmoving object monitoring process. An image pickup unit position information represents information (which includes information identifying monitoring spots in capturing images and may include information such as zoom, pan and tilt) identifying the position of the image pickup unit 201 of the network camera 101. An unmoving object position information represents information identifying the position of an unmoving object within the image pickup range by the image pickup unit 201. An unmoving object monitoring timer ID represents information identifying which the unmoving object monitoring timers expire when the expiration of the unmoving object monitoring timers is notified with the timer ID from the clock unit 206. An expiration flag represents information on whether the unmoving object monitoring timer expires.

A monitoring operation according to a first embodiment of a network camera monitoring system combining the tour monitoring process with the unmoving object monitoring process is described with reference to FIGS. 6 to 9.

Figure 6:
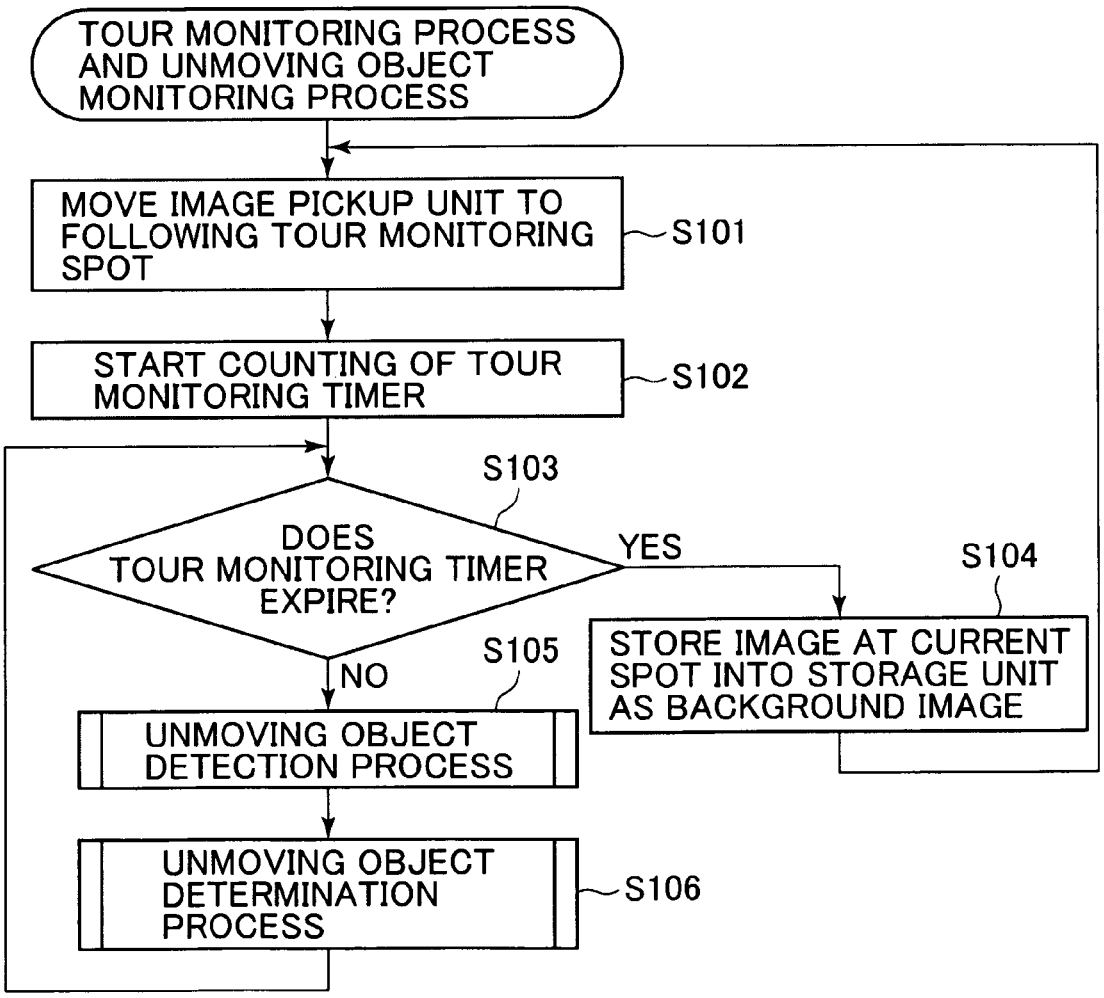
FIG. 6 is a flow chart showing steps of the first embodiment of the tour monitoring process and the unmoving object monitoring process executed by the network camera in FIG. 1.

FIG. 6 is a flow chart showing general steps of the first embodiment of the tour monitoring process and the unmoving object monitoring process executed by the network camera in FIG. 1.

As shown in FIG. 6, in step S101, the control unit 203 reads information on the following monitoring spot out of the tour monitoring registration spots 111 to 115 shown in FIG. 1 from the storage unit 205 and moves the image pickup unit 201 to the following spot through the image pickup control unit 202.

In step S101, the image pickup unit 201 cyclically monitors a plurality of previously registered monitoring spots (the tour monitoring registration spots 111 to 115). The network camera monitoring system has a function to perform such a tour monitoring process.

In step S102, the control unit 203 reads the tour monitoring time t100 shown in FIG. 4 from the storage unit 205 and instructs the clock unit 206 to start the tour monitoring timer.

In step S103, the control unit 203 determines whether the tour monitoring timer expires. The tour monitoring timer expires on reaching the set tour monitoring time t100. When the tour monitoring timer expires (step S103=YES), the image captured by the image pickup unit 201 is stored in the storage unit 205 as a background image at the current monitoring spot (step S104).

An unmoving object detection process (step S105) and an unmoving object determination process (step S106) are executed before the tour monitoring timer expires (step S103=NO). And then the process returns to determination in step S103.

In steps S104 to S106, the image pickup unit 201 monitors an unmoving object at the monitoring spot during the unmoving object monitoring time t200 based on the previously captured background image before the image pickup unit 201 moves from the predetermined monitoring spot to the following monitoring spot according to the tour monitoring process. The network camera monitoring system has a function to perform such an unmoving object monitoring process.

Figure 7:
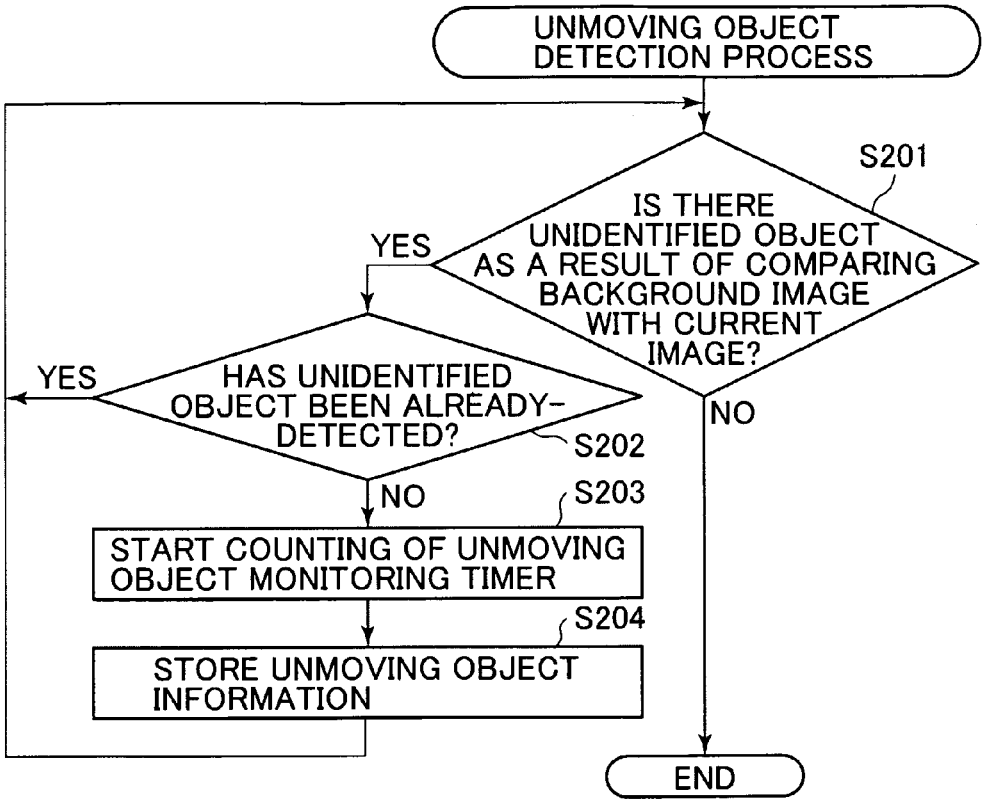
FIG. 7 is a flow chart showing steps for the unmoving object detection process executed in step S105 in FIG. 6.

FIG. 7 is a flow chart showing steps for the unmoving object detection process executed in step S105 in FIG. 6.

As shown in FIG. 7, in step S201 in the unmoving object detection process, the control unit 203 compares the background image at the current spot stored in the storage unit 205 with the data picked up by the image pickup unit 201 to determine whether there is an unidentified object. When an unidentified object is not found (step S201=NO), the present process is ended. When an unidentified object is found (step S201=YES), the process proceeds to step S202.

In step S202, the control unit 203 searches for an unmoving object information in which the image pickup unit position information is the same as the position of the current image pickup unit 201 and as the position information in the image pickup range of the unmoving object where the unmoving object position information is found, from the unmoving object information table tb100.

When the unmoving object information corresponding to the found unidentified object is not found in the unmoving object information table tb100 (step S202=NO), it is determined that the unidentified object is a new unmoving object and the process proceeds to step S203. On the other hand when the unmoving object information corresponding to the found unidentified object is found (step S202=YES), it is determined that the unidentified object is the already-detected unmoving object and the process returns to a comparison process between the background image and the picked up image (step S201) to search for other unidentified objects.

In step S203, the control unit 203 obtains the unmoving object monitoring time t200 (refer to FIG. 4) from the storage unit 205 and instructs the clock unit 206 to start the tour monitoring timer (starting counts).

At this point, the control unit 203 stores the current position of the image pickup unit 201, the position of the unidentified object within the image pickup range of the image pickup unit 201 and the timer ID returned by the clock unit 206 in the unmoving object information table tb100 stored in the storage unit 205 (step S204). That is to say, these pieces of information are stored as the image pickup unit position information, the unmoving object position information and the unmoving object monitoring timer ID.

In step S204, the unmoving object monitoring position is stored when the count of the unmoving object monitoring time starts according to the unmoving object monitoring process. The network camera monitoring system has a function to perform such a storing process.

Following step S204, the process returns to the comparison process between the background image and the picked up image (step S201) to search for other unidentified objects.

Figure 8:
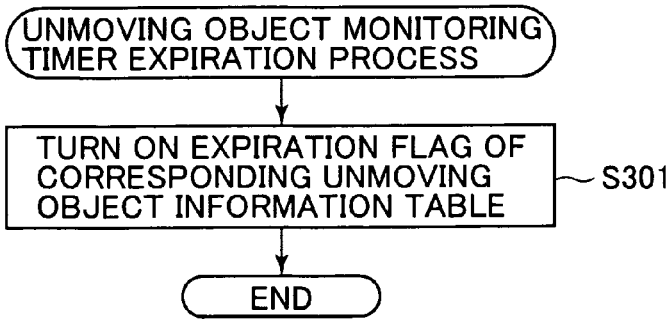
FIG. 8 is a flow chart showing steps for an expiration process performed when the unmoving object monitoring timer started in step S203 in FIG. 7 expires.

FIG. 8 is a flow chart showing steps for an expiration process performed when the unmoving object monitoring timer started in step S203 in FIG. 7 expires.

As shown in FIG. 8, in step S301, the control unit 203 searches for the unmoving object information having the unmoving object monitoring timer ID which is the same as the timer ID that has expired from the unmoving object information table tb100 and sets the expiration flag of the unmoving object information corresponding thereto from OFF to ON.

Figure 9:
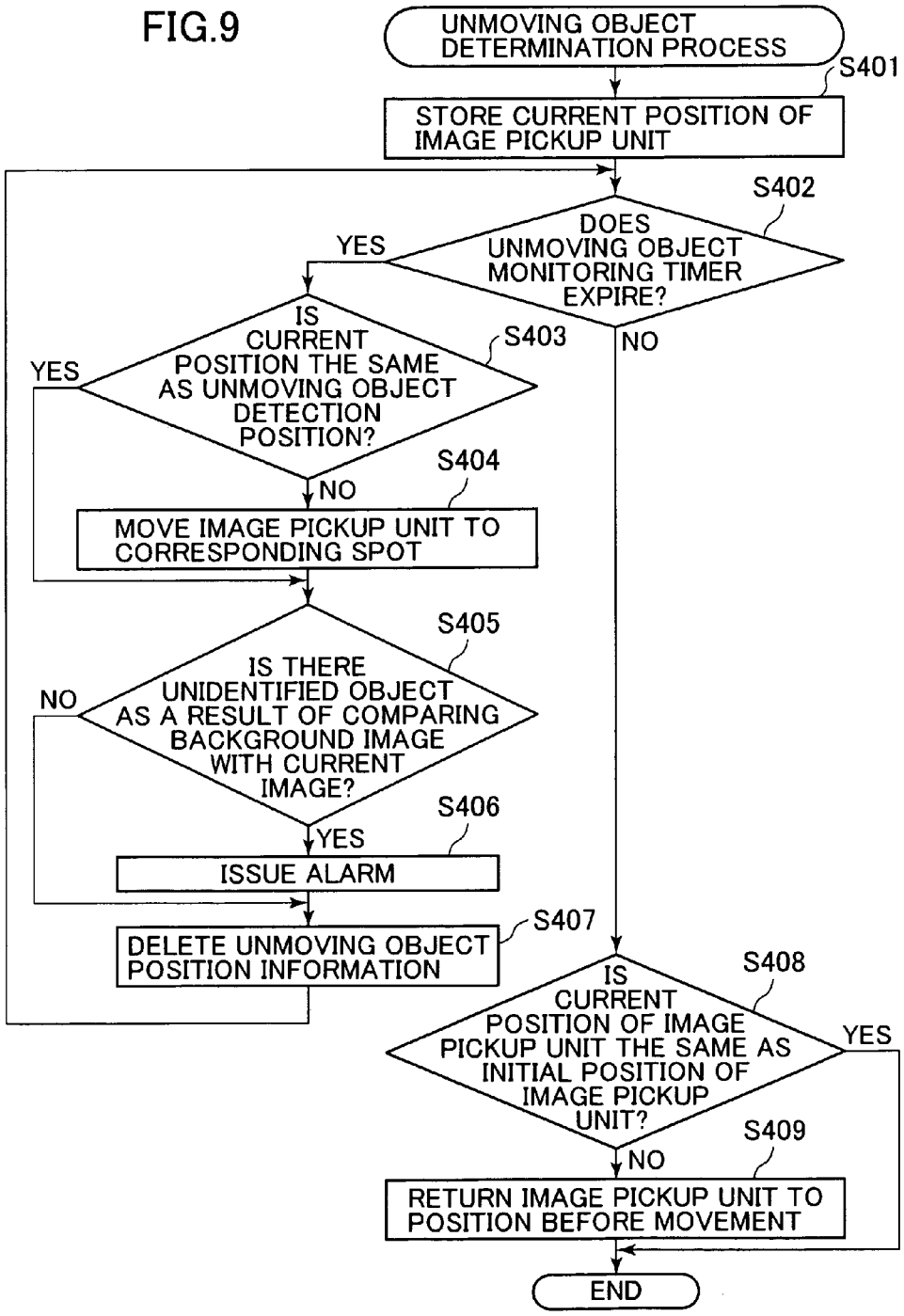
FIG. 9 is a flow chart showing steps for the unmoving object determination process executed in step S106 in FIG. 6.

FIG. 9 is a flow chart showing steps for the unmoving object determination process executed in step S106 in FIG. 6.

As shown in FIG. 9, in step S401, the current position of the image pickup unit 201 is stored in the local storage area of the storage unit 205.

In step S402, the control unit 203 retrieves the expiration flag of the unmoving object information table tb100 stored in the storage unit 205 to determine whether the unmoving object monitoring timer expires in step S301 in FIG. 8.

The process proceeds to step S408 before the unmoving object monitoring timer expires (step S402=NO). The process proceeds to step S403 when the unmoving object monitoring timer expires (step S402=YES).

In step S403, the control unit 203 reads the image pickup unit position information in connection with the unmoving object information in which the expiration flag is turned ON to compare the position of the image pickup unit 201 indicated by the image pickup unit position information with the current position of the image pickup unit 201. When the positions of the image pickup unit 201 are the same as each other (step S403=YES), the process proceeds to step S405. When the positions of the image pickup unit 201 are different from each other (step S403=NO), the process proceeds to step S404.

In step S404, the control unit 203 moves the image pickup unit 201 to the position indicated by the image pickup unit position information of the unmoving object information.

In step S404, if the image pickup unit 201 is moved to another monitoring spot in the tour monitoring process while the unmoving object monitoring time elapses, the image pickup unit 201 is moved to the unmoving object monitoring position stored in the storage unit 205 at the predetermined time. The network camera monitoring system has a function to perform such a moving process.

The predetermined time represents the timing at which the unmoving object monitoring time elapses. The predetermined time also represents the timing at which the monitoring spot of the image pickup unit 201 is moved in the tour monitoring process performed for the first time after the unmoving object monitoring time has elapsed. In addition, the predetermined time represents the timing at which the image pickup unit 201 is moved to the first image pickup position stored in the storage unit 205 in the tour monitoring process after the unmoving object monitoring time has elapsed.

In step S405, the control unit 203 compares the background image at the current spot stored in the storage unit 205 with the data picked up by the image pickup unit 201 within the range of the unmoving object position information of the unmoving object information to determine whether there is an unidentified object.

In step S405, a determination is made as to whether the unmoving object is unidentified at the unmoving object monitoring position after the movement of the image pickup unit 201. The network camera monitoring system has a function to perform such a determination process.

When an unidentified object exists (step S405=YES), the control unit 203 gives the server 102 the alarm about the discovery of the unidentified object through the communication unit 204 (step S406). The server 102 informs the user of the network camera monitoring system about the discovery of the unidentified object based on the alarm by sound, light and so on.

In step S406, when it is determined that an unmoving object is unidentified in the determination process, the alarm is given. The network camera monitoring system has a function to perform such an alarm issuing process.

On the other hand, when an unidentified object disappears (step S405=NO), the process proceeds to step S407.

In step S407, the unmoving object information in which the unmoving object determination process has been finished is deleted from the unmoving object information table tb100 and the process returns to step S402.

In step S408, the position indicated by position information of the image pickup unit 201 stored in the local storage area in step S401 is compared with the current position of the image pickup unit 201. When these positions are different from each other (step S408=NO), the image pickup unit 201 is moved to the position of the image pickup unit 201 stored in the local storage area of the storage unit 205 (step S409). When there is no difference between these positions (step S408=YES), the process ends.

The first embodiment in which the network camera monitoring system is operated such that the tour monitoring process is combined with the unmoving object monitoring process is described above with reference to FIGS. 6 to 9.

According to the aforementioned first embodiment, a user can set the network camera monitoring system without considering a mutual dependence of the tour monitoring time and the unmoving object monitoring time in setting each time.

In the first embodiment, although the position of the image pickup unit 201 returns to the registered spot where the tour monitoring is interrupted after the alarm is issued to the user in the unmoving object determination process, this does not always apply. For example, the tour monitoring may be continued from the unmoving object determination spot. In addition, image pickup may be continued at the unmoving object determination spot until the server 102 issues instructions.

The execution timing of the unmoving object determination process described in FIG. 9 is not always limited to that shown in FIG. 6, but that in a second or a third embodiment described below may be applied.

Figure 10:
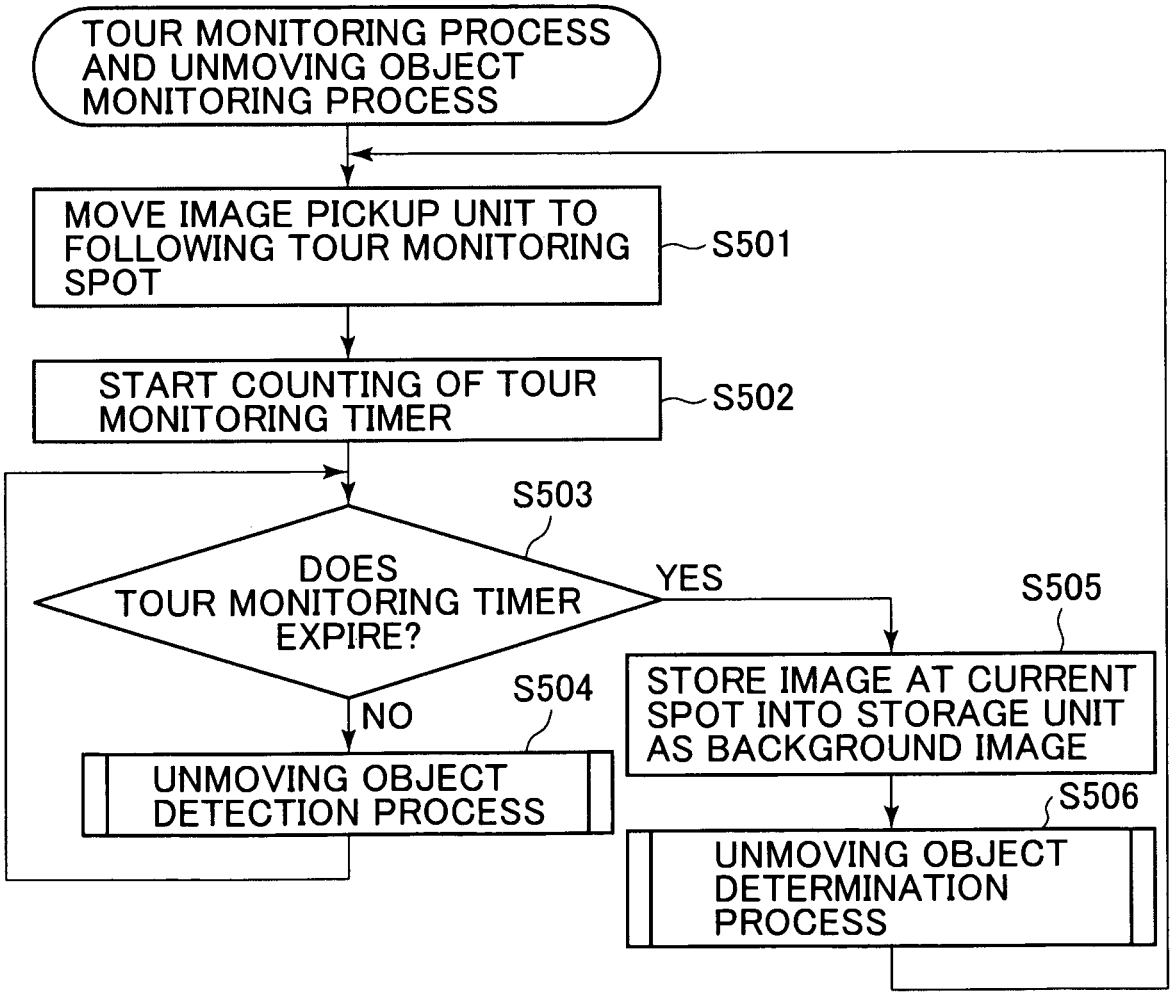
FIG. 10 is a flow chart showing steps of the second embodiment of the tour monitoring process and the unmoving object monitoring process executed by the network camera in FIG. 1.

FIG. 10 is a flow chart showing steps of the second embodiment of the tour monitoring process and the unmoving object monitoring process executed by the network camera in FIG. 1.

As shown in FIG. 10, in step S501, the control unit 203 reads the first tour monitoring registration spot 111 from the storage unit 205 and moves the image pickup unit 201 to the spot through the image pickup control unit 202.

In step S502, the control unit 203 reads the tour monitoring time t100 from the storage unit 205 and instructs the clock unit 206 to start the tour monitoring timer.

In step S503, the control unit 203 determines whether the tour monitoring timer expires. When the tour monitoring timer does not yet expire (step S503=NO), the unmoving object detection process (step S504) is executed.

When the tour monitoring timer expires (step S503=YES), the image captured by the image pickup unit 201 is stored in the storage unit 205 as a background image at the current monitoring spot (step S505) and then the unmoving object determination process is performed (step S506). The process returns to the determination process in step S501 as to whether the unmoving object monitoring timer expires.

Figure 11:
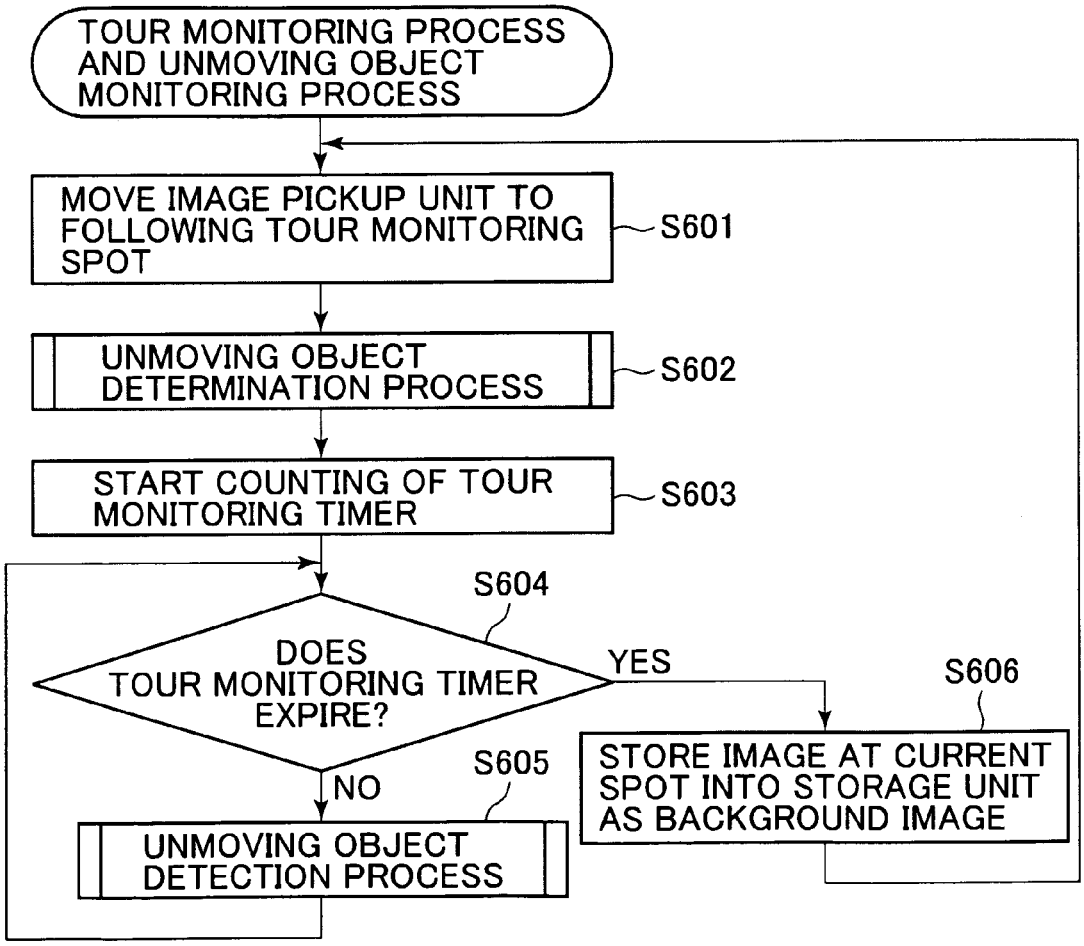
FIG. 11 is a flow chart showing steps of the third embodiment of the tour monitoring process and the unmoving object monitoring process executed by the network camera in FIG. 1.

FIG. 11 is a flow chart showing steps of the third embodiment of the tour monitoring process and the unmoving object monitoring process executed by the network camera in FIG. 1.

As shown in FIG. 11, in step S601, the control unit 203 reads the first tour monitoring registration spot 111 from the storage unit 205 and moves the image pickup unit 201 to the spot through the image pickup control unit 202.

In step S602, there is executed the unmoving object determination process shown in FIG. 12 described later.

In step S603, the control unit 203 reads the tour monitoring time t100 from the storage unit 205 and instructs the clock unit 206 to start the tour monitoring timer.

In step S604, the control unit 203 determines whether the tour monitoring timer expires. When the tour monitoring timer does not yet expire (step S604=NO), the unmoving object detection process (step S605) is executed.

When the tour monitoring timer expires (step S604=YES), the image captured by the image pickup unit 201 is stored in the storage unit 205 as a background image at the current monitoring spot (step S606) and then the process returns to step S601.

Figure 12:
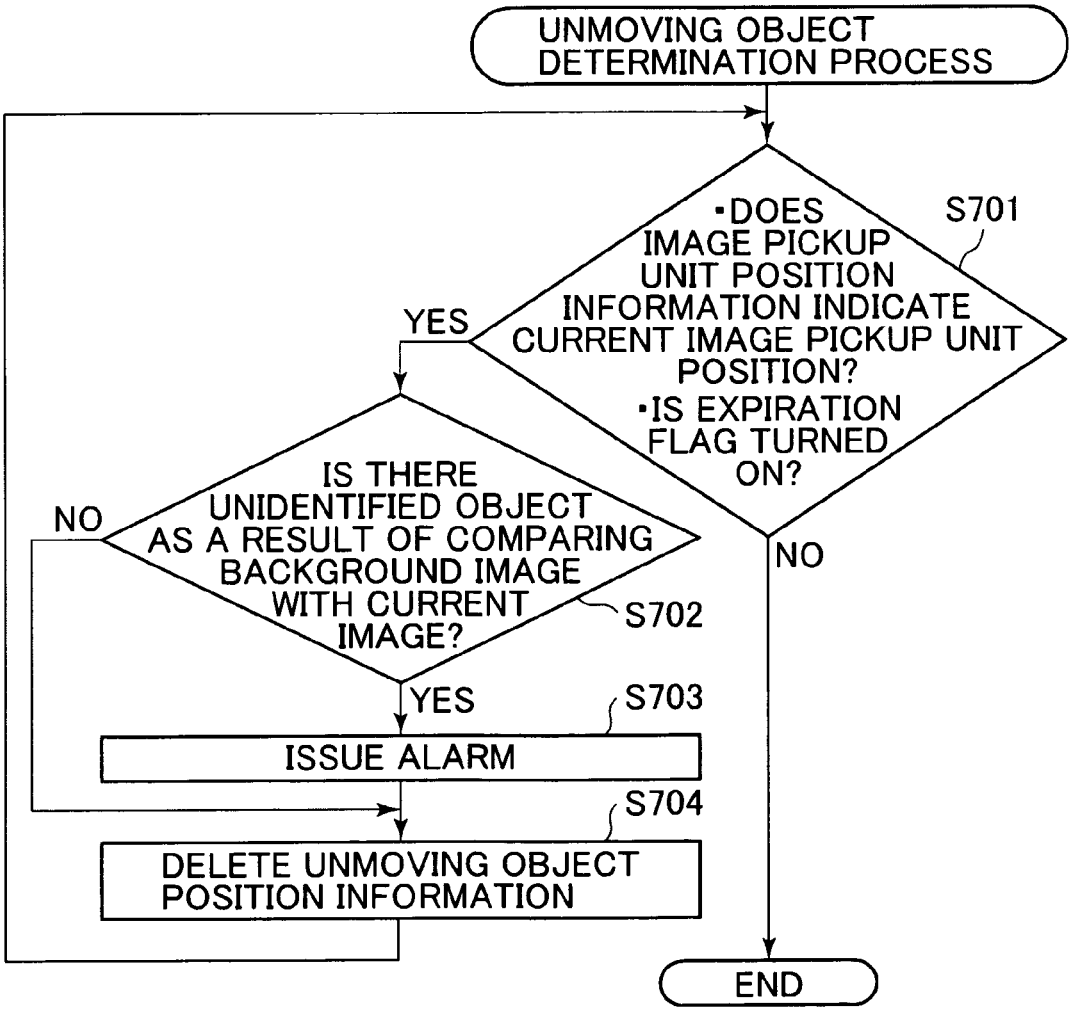
FIG. 12 is a flow chart showing steps for the unmoving object determination process executed in step S602 in FIG. 11.

FIG. 12 is a flow chart showing steps for the unmoving object determination process executed in step S602 in FIG. 11.

As shown in FIG. 12, in step S701, the control unit 203 searches for an unmoving object information in which an image pickup unit position information indicates the current position of the image pickup unit 201 and an expiration flag is on from the unmoving object information table tb100 stored in the storage unit 205.

When the corresponding unmoving object information is not found (step S701, NO), the process ends. When the corresponding unmoving object information is found (step S701, YES), the process proceeds to step S702.

In step S702, the control unit 203 compares the background image at the current spot stored in the storage unit 205 with the data picked up by the image pickup unit 201 within the range of the unmoving object position information of the found unmoving object information to determine whether there is an unidentified object.

When an unidentified object exists (step S702=YES), the control unit 203 gives the server 102 the alarm about the discovery of the unidentified object through the communication unit 204. When an unidentified object disappears (step S702=NO), the process proceeds to step S704.

In step S704, the control unit 203 erases the unmoving object information from the unmoving object information table tb100. After that, the process returns to step S701 in which a determination is made as to whether the unmoving object monitoring timer expires.

A fourth embodiment of the present invention is described below. In the first to third embodiments, the unmoving object monitoring process has priority over the tour monitoring process and the tour monitoring process is interrupted to execute the unmoving object monitoring process. On the other hand, in the present embodiment, the tour monitoring process has priority over the unmoving object monitoring process and the unmoving object monitoring process is executed with its content partially changed while the tour monitoring process is being executed as usual.

The general steps for the tour monitoring process and the unmoving object monitoring process in the present embodiment are the same as those in FIG. 6 described in the first embodiment. The steps for the unmoving object detection process are the same as those in FIG. 7 described in the first embodiment. In the present embodiment, the unmoving object determination process is executed according to the steps shown in FIG. 13.

Figure 13:
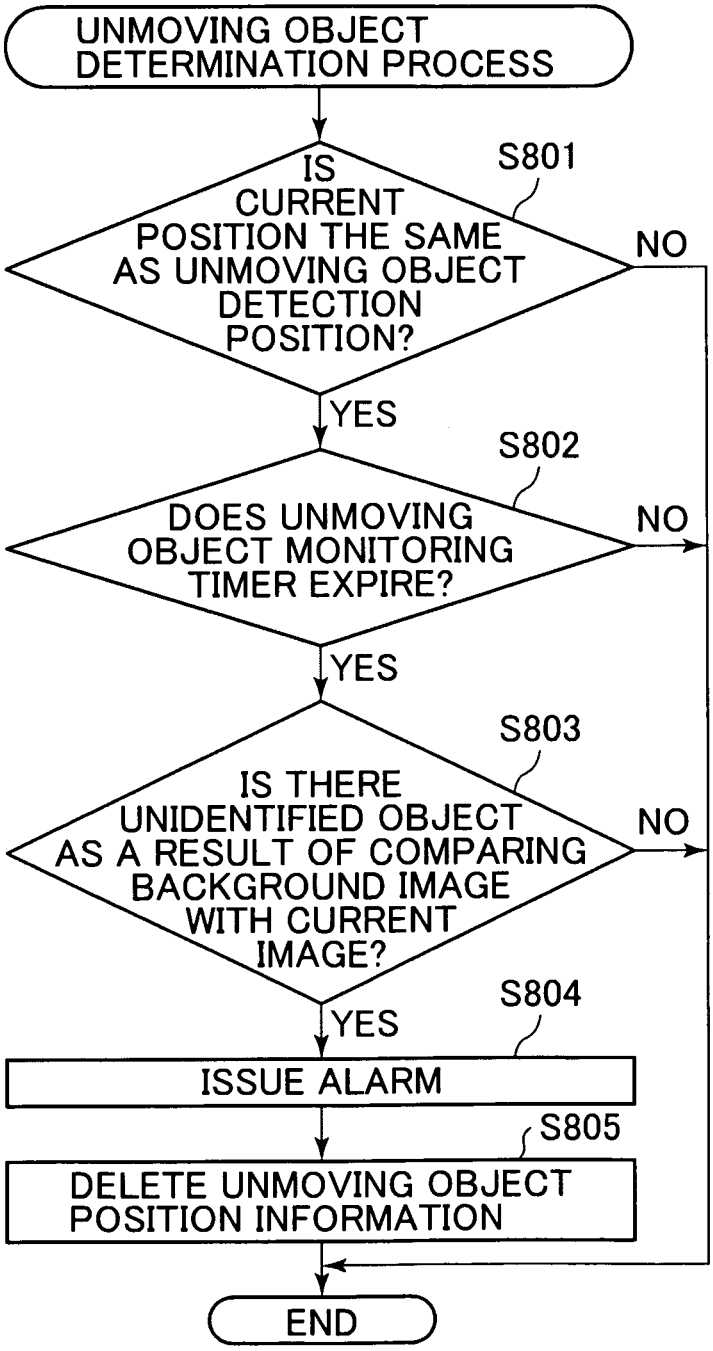
FIG. 13 is a flow chart showing steps for the unmoving object determination process in the fourth embodiment.

FIG. 13 is a flow chart showing steps for the unmoving object determination process in the fourth embodiment. As shown in FIG. 13, in step S801, the control unit 203 reads the image pickup unit position information to compare the position of the image pickup unit 201 indicated by the image pickup unit position information with the current position of the image pickup unit 201. When the position of the image pickup unit 201 is the same as the position indicated by any of the image pickup unit position information (step S801=YES), the process proceeds to step S802. When the positions of the image pickup unit 201 are different from each other (step S801=NO), the process ends.

In step S802, the control unit 203 refers to the expiration flag in the unmoving object detection position corresponding to the current position in the unmoving object information table tb100 stored in the storage unit 205 to check whether the unmoving object monitoring timer expires.

When the unmoving object monitoring timer does not expire (step S802=NO), the process ends. When the unmoving object monitoring timer expires (step S802=YES), the process proceeds to step S803.

In step S803, a determination is made as to whether an unmoving object is unidentified at the current position of the image pickup unit 201. When an unidentified object exists (step S803 YES), the control unit 203 gives the server 102 the alarm about the discovery of the unidentified object through the communication unit 204 (step S804). On the other hand, when an unidentified object disappears (step S803=NO), the process ends.

In step S805 following step S804, the unmoving object information in which the unmoving object determination process has finished is deleted from the unmoving object information table tb100 and the process ends.

Thus, even if an unmoving object is detected in the unmoving object detection process, the tour monitoring process is not interrupted in the midst of the process thereafter. The unmoving object determination process is executed when the image pickup unit 201 returns to the same tour monitoring position. For this reason, according to the present embodiment, the unmoving object detection process can also be executed in each position in parallel while importance is attached to the tour monitoring process in which a plurality of positions is equally monitored.

A fifth embodiment of the present invention is described below. In the first to fourth embodiments, the image pickup unit is stopped at the predetermined tour monitoring spots for a predetermined time in the tour monitoring process to be intermittently controlled so as to monitor a plurality of image pickup spots. In the present embodiment, the image pickup unit performs a tour monitoring in a continuous range while picking up images without being stopped and executes the unmoving object detection process as well.

The steps for the unmoving object detection process and the unmoving object determination process in the present embodiment are the same as those in FIGS. 7 and 8 described in the first embodiment. The steps for the unmoving object determination process may be executed according to those in FIG. 13. In the present embodiment, the general steps for the tour monitoring process and the unmoving object monitoring process are executed by those shown in FIG. 14.

Figure 14:
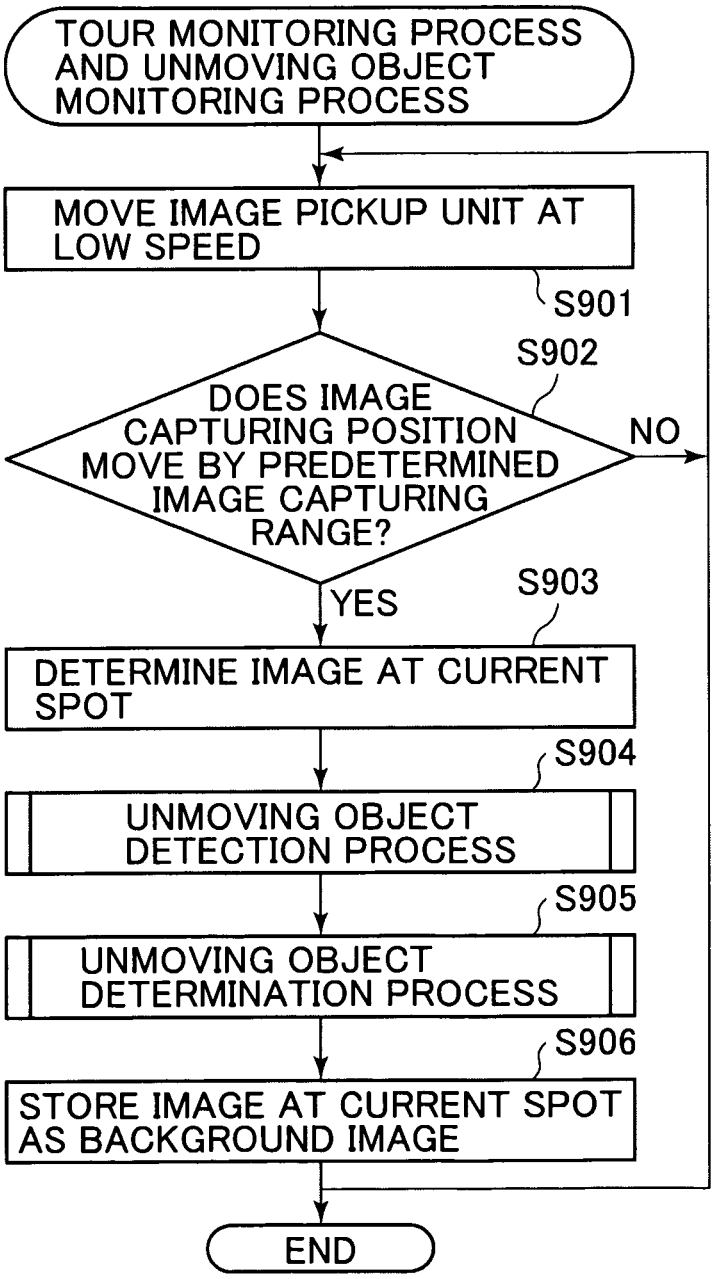
FIG. 14 is a flow chart showing steps for the tour monitoring process and the unmoving object monitoring process in the fifth embodiment.
Figure 15:
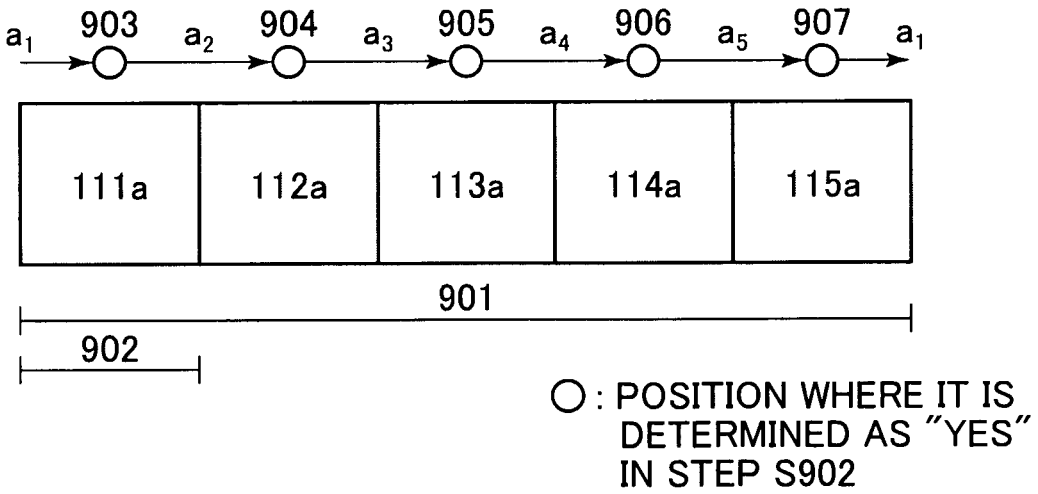
FIG. 15 is a diagram describing the movement of the image pickup unit in the fifth embodiment.

FIG. 14 is a flow chart showing steps for the tour monitoring process and the unmoving object monitoring process in the fifth embodiment. As shown in FIG. 14, in step S901, the control unit 203 moves the image pickup unit 201 at a low speed. FIG. 15 is a diagram describing the movement of the image pickup unit in the present embodiment. In FIG. 15, reference numeral 901 denotes the whole image-pickup range to be monitored. Reference numeral 902 indicates the range of angle of view in which the image pickup unit 201 can capture images. Reference numerals 111*a* to 115*a* signify image capturing ranges corresponding to the tour monitoring registration spots 111 to 115 in FIG. 1 and are adjacent to each other and continuous. Each of the circles indicated by reference numerals 903 to 907 means image capturing points where the image pickup unit 201 captures an image in the image capturing ranges 111*a* to 115*a*.

In the first to fourth embodiments described above, the image pickup unit 201 stops at the image capturing points 903 to 907 of the tout monitoring registration spots 111 to 115 in FIG. 1 to capture images. Between the tour monitoring registration spots 111 to 115, however, the image pickup unit 201 moves at a high speed and does not capture images. On the other hand, in the present embodiment, as is not the case with the first to fourth embodiments, the image pickup unit 201 is caused to move at a low speed without being stopped and without having information of the tour monitoring registration spots 111 to 115, thereby the image pickup unit 201 captures images even at intervals indicated by arrows $a_1$ to $a_5$ in FIG. 15.

It should be noted that the image pickup unit 201 moves at a speed lower than the speed at which the image pickup unit 201 moves between the tour monitoring registration spots 111 to 115 in the first to fourth embodiments and at a speed which is low to such an extent that movement in the image capturing range in the period required for the unmoving object detection process does not put obstacles in the way of the unmoving object detection process. In the present embodiment, although on reaching the right end of the monitoring range in FIG. 15, the image pickup unit 201 moves at a high speed to the left end and continues capturing, the image capturing direction may be switched to the opposite direction as it is to continue capturing.

In step S902, a determination is made as to whether the image capturing position moves by a predetermined image capturing range. In the present embodiment, the predetermined image capturing range corresponds to the angle of view 902 in FIG. 15. For this reason, at the position of the image pickup unit 201 moving from the image capturing point 903 to before the image capturing point 904, for example, it is determined that the image pickup unit 201 does not move (step S902=NO) to continue capturing images. When the image pickup unit 201 reaches the image capturing point 904, it is determined that the image pickup unit 201 has moved (step S902=YES).

In step S903, the image captured when it is determined as "YES" in step S902 is determined as the image at the current spot. The unmoving object detection process (step S904) and the unmoving object determination process (step S905) are executed based on the determined image. The unmoving object position information in the unmoving object information table in FIG. 5 is managed as position in the whole image capturing range. As is not the case with the first to fourth embodiments, positions are not registered, so that, if the unmoving object monitoring timer expires, the image pickup unit is moved so that the position of the corresponding unmoving object centers at the image.

In step S906, the image at the current spot determined in step S903 is stored as a background image. The image pickup unit continues moving at a speed lower to perform the tour monitoring (step S901).

Executing the whole steps for the tour monitoring process and the unmoving object monitoring process also enables the unmoving object detection process to be executed in parallel while executing the tour monitoring process which monitors the range to be monitored all over.

Although the embodiments of the present invention are described above, the present invention is not limited to those embodiments.

For example, all the functions in the first to fifth embodiments may be implemented to enable a user to select one of the functions.

It is to be understood that the object of the present invention may also be accomplished by supplying a system or an apparatus with a storage medium in which a program code of software which realizes the functions of the above described embodiments is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored configure the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of the above described embodiments may be accomplished not only by executing the program code read out by a computer, but also by causing an OS (operating system) or the like which runs on the computer to perform a part or all of the actual operations based on instructions of the program code.

Further, it is to be understood that the functions of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Applications No. 2008-98366 filed Apr. 4, 2008 and No. 2009-069951 filed Mar. 23, 2009, which are hereby incorporated by reference herein in its entirety.

What is claimed is:

1. A monitoring device comprising:

a tour monitoring unit adapted to cause an image pickup unit to cyclically monitor a plurality of previously registered monitoring spots;

an unmoving object monitoring unit adapted to monitor an unmoving object at the monitoring spot for a predetermined unmoving object monitoring time based on a previously captured background image before the image pickup unit is moved from the predetermined monitoring spot by said tour monitoring unit;

a storage unit adapted to store an unmoving object monitoring position when said unmoving object monitoring unit starts counting the unmoving object monitoring time;

a first determination unit adapted to determine whether the predetermined unmoving object monitoring time for the unmoving object elapses or not while said tour monitoring unit causes the image pickup unit to cyclically monitor a plurality of the spots;

a moving unit adapted to forcibly move the image pickup unit to the unmoving object monitoring position stored in said storage unit at a predetermined timing if the image pickup unit is moved to another monitoring spot at which the unmoving object is not yet found by said tour monitoring unit when said first determination unit determines that the predetermined unmoving object monitoring time for the unmoving object elapses; and a second determination unit adapted to determine whether the unmoving object is unidentified at the unmoving object monitoring position to which the image pickup unit is moved by said moving unit, wherein the predetermined unmoving object monitoring time is longer than the tour monitoring time during which the image pickup unit cyclically monitors any one of the monitoring spots.

2. The monitoring device according to claim 1, wherein the predetermined timing represents a period for which the image pickup unit is moved by said tour monitoring unit to the monitoring spot created for the first time after the predetermined unmoving object monitoring time has elapsed.

3. The monitoring device according to claim 1, further comprising an alarm issuing unit adapted to issue an alarm when said second determination unit determines that the unmoving object is unidentified.

4. The monitoring device according to claim 1, wherein said tour monitoring unit moves the image pickup unit to the monitoring spot where the tour monitoring is interrupted after said second determination unit determines whether the unmoving object is unidentified and said tour monitoring unit continues the tour monitoring.

5. The monitoring device according to claim 1, wherein said tour monitoring unit continues cyclically monitoring the monitoring spot determined by said second determination unit after said second determination unit determines whether the unmoving object is unidentified.

6. The monitoring device according to claim 1, wherein the predetermined timing represents a timing at which the monitoring time elapses.

7. The monitoring device according to claim 1, further comprising:

an input unit adapted to receive inputs from a user, wherein the user can input the predetermined unmoving object monitoring time and the tour monitoring time;

wherein the input unit allows a user to input a predetermined unmoving object monitoring time that is longer than the input tour monitoring time during which the image pickup unit cyclically monitors any one of the monitoring spots.

* * * * *